United States Patent [19]

Wilson

[11] 4,014,153

[45] Mar. 29, 1977

[54] FLUID DISPLACEMENT OF NONCONDENSIBLE GAS FROM VOIDS IN PRODUCTS

[75] Inventor: Donald C. Wilson, San Jose, Calif.

[73] Assignee: FMC Corporation, San Jose, Calif.

[22] Filed: Jan. 19, 1976

[21] Appl. No.: 650,345

[52] U.S. Cl. ..... 53/21 FC; 53/22 B; 53/110; 53/112 B; 141/44; 426/486; 426/506

[51] Int. Cl.[2] ..... B65B 31/02

[58] Field of Search ..... 53/21 FC, 22 R, 22 B, 53/111, 112 R, 112 B, 110; 426/402, 486, 506; 134/25 R; 141/44

[56] References Cited

UNITED STATES PATENTS

| | | | |
|---|---|---|---|
| 3,477,193 | 11/1969 | Mobley | 53/112 R X |
| 3,860,047 | 1/1975 | Finkelmeier et al. | 53/112 R X |

*Primary Examiner*—Travis S. McGehee
*Attorney, Agent, or Firm*—A. J. Moore; C. E. Tripp

[57] ABSTRACT

A method and apparatus for excluding a noncondensible gas from voids in a particulate product and thereafter filling the degassed product into a container. If the product includes only entrapped voids, a liquid is directed upwardly through the product in a degassing chamber to purge noncondensible gases from the voids. The upper end of the chamber is then closed at a point below the liquid level and the lower end of the chamber is opened to discharge the degassed product and liquid into a separating mechanism which causes the product to gravitate into the container and the liquid to be collected in a sump for recirculation.

If the product is a low free liquid porous food product that includes both entrapped and occluded voids, the degassing chamber is first closed and vacuumized. The liquid is then directed upwardly through the product in the degassing chamber while vacuumization continues. The degassing chamber subsequently returns to atmospheric pressure at which time liquid enters the occluded voids and substantially all noncondensible gas is withdrawn from the degassing chamber. The lower end of the chamber is then opened to discharge the degassed product and liquid as above described. The resulting filled and sealed container comprises an article of manufacture in the nature of a sealed container with the noncondensible gas removed from the occluded voids being replaced by a liquid.

28 Claims, 9 Drawing Figures

FIG_5
LOWER GATE-CLOSED
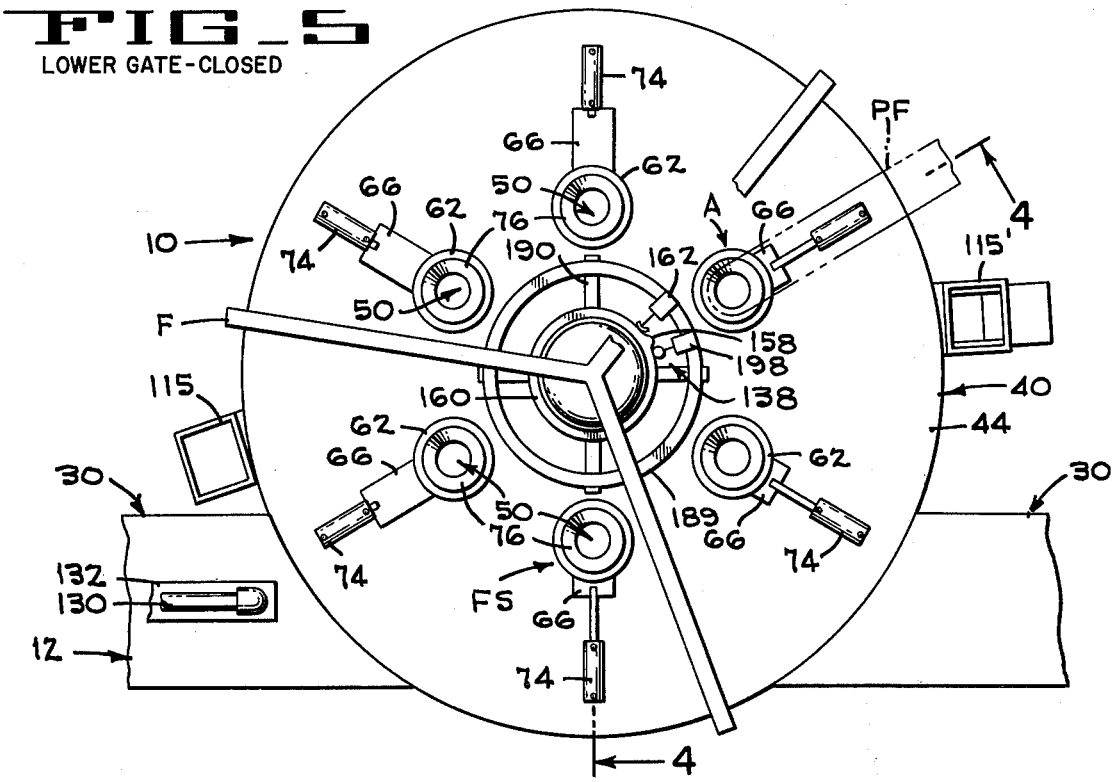
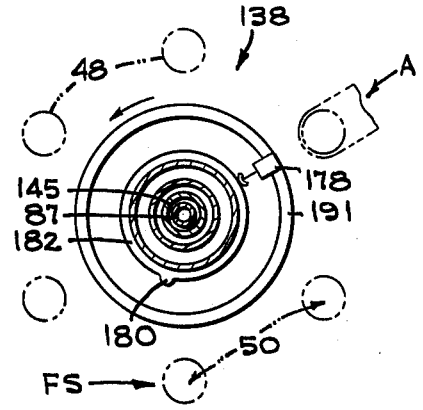
LOWER GATE-OPEN
FIG_6
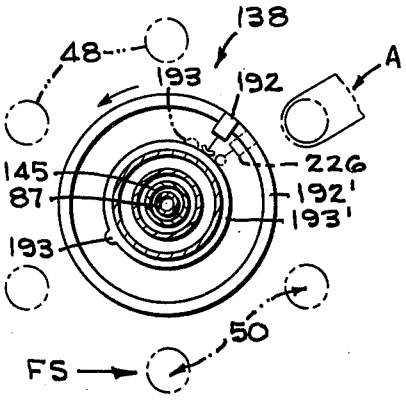
UPPER GATE-CLOSED
FIG_7
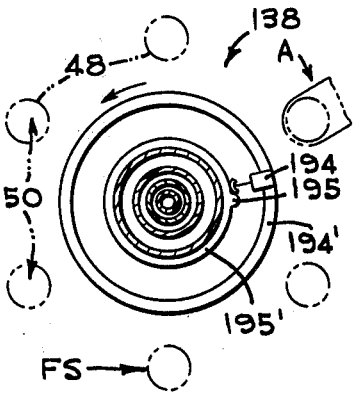
UPPER GATE-OPEN
FIG_8
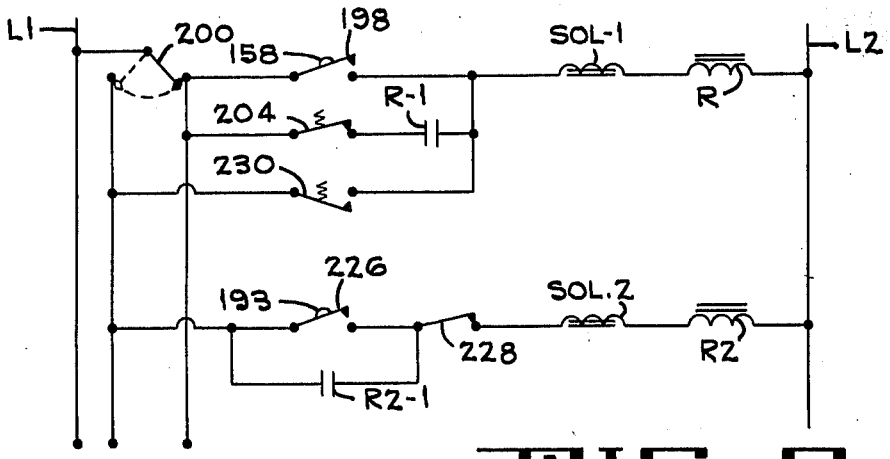
FIG_9

FLUID DISPLACEMENT OF NONCONDENSIBLE GAS FROM VOIDS IN PRODUCTS

CROSS REFERENCE TO RELATED APPLICATIONS

This application relates to the type of air purging apparatus disclosed in U.S. Wilson et al Application Ser. No. 520,085, which application was filed on Nov. 1, 1974 and is assigned to the assignee of the present invention.

This application also relates to the method of and apparatus for excluding air from pouches as defined in U.S. Wilson application Ser. No. 650,347, in U.S. Chiu et al application Ser. No. 650,348, and U.S. Mencacci application Ser. No. 650,346; all three applications being filed on even date herewith and being assigned to the assignee of the present invention.

BACKGROUND OF THE INVENTION

1. Field of the Invention

This invention pertains to fillers for particulate products and more particularly relates to a method and apparatus for displacing a noncondensible gas entrapped between individual particles of a particulate product and/or displacing a noncondensible occluded gas from voids within the particles of the product.

2. Description of the Prior Art

Air or other noncondensible gases may be present in product filled flexible containers or pouches from several sources. A first source is the generation of gases by microbal action within the pouch. The formation of such gases may be controlled by immediately sterilizing the container and its contents after the container has been sealed. A second source is the generation of hydrogen, carbon monoxide or carbon dioxide due to chemical breakdown during heat processing and lengthy storage. However, the amount of gas formed by chemical breakdown is usually quite minor. A third source is headspace gas which is that noncondensible gas in the container or pouch that may be removed from the container by several means including those disclosed in the above cross-referenced applications.

Two other sources of noncondensible gases, the removal of which constitutes the subject matter of the present invention, are gases entrapped in voids between particles of a product and/or gases which are entrapped in occluded voids in the particles themselves. Entrapped void gas is the noncondensible gas that is present between individual particles in the particulate product, whereas occluded void gas is the noncondensible gas that is found within voids in the individual particles of the products themselves.

It is well known in the art to purge air and cooking gases from flexible containers or pouches having their upper ends closed, but not sealed, by moving the containers alternately through steam and water baths during processing thereby progressively forcing noncondensible gas from voids which exist between the individual particles of a particulate product in the pouch as well as out of the pouch itself. U.S. Wilson Pat. No. 3,501,318 which issued on Mar. 17, 1970 discloses such a system and is incorporated by reference herein.

U.S. Wilson Pat. No. 3,528,826 which issued on Sept. 15, 1970 discloses a similar system wherein filled and partially sealed flexible containers are alternately moved into hot water and cold water troughs to first form steam within the containers and to then condense the steam to progressively drive the steam-air mixture from within the containers.

U.S. Pat. No. 3,871,157 which issued to Domke et al on Mar. 18, 1975, discloses a bag packaging apparatus wherein bags are severed from a film strip and are thereafter opened, filled and closed while moving through a hood that is divided into compartments. Each compartment is provided with means for independently adjusting the supply of protective gas directed into each compartment. After the bags have been closed they are moved out of the hood and are sealed while in an environment of air.

Johnson et al Pat. No. 3,619,975 issued in the United States on Nov. 16, 1971, and discloses a pouch packaging machine which severs pouches from a strip of film at a point outside of a hood. The pouches are first opened while outside the hood with the aid of a splitting bar and a jet of gas such as nitrogen, and are thereafter advanced under a shallow hood having a non-oxidizing gas flowing therein. The pouch is thereafter again widely opened at the filling station by suction cups, is filled with an air-free product and is then advanced to a purging station. While at the purging station a tube is lowered through the product in the filled pouch and directs a non-oxidizing gas into the filled pouch to purge air therefrom. The pouch is subsequently sealed while its upper end is disclosed under and aligned with a slot in the floor of the hood.

SUMMARY OF THE INVENTION

In accordance with the present invention, air or other noncondensible gases are displaced from voids between individual particles of a particulate product as well as from voids in the individual particles themselves.

If the entrapped noncondensible gases, i.e., the gases present in voids between particles, are to be displaced; then the particulate product is loaded into a degassing chamber provided with upper and lower gates, with the lower gate being closed. A liquid such as water is directed into the bottom of the chamber and raises to a level above the uppermost gate thus displacing the air and other noncondensible gases with the liquid, hereinafter referred to as water. The upper gate is then closed and the lower gate is opened allowing water and the product to gravitate down an inclined, perforated steam filled tube with the product gravitating into an open steam filled container (hereinafter referred to as a pouch) and with the water draining through the perforations in the tube for collection and recirculation during the next degassing cycle.

If products having both entrapped gases in the voids between the individual pieces of the product, and occluded gases within the voids in the product itself, the above procedure is slightly altered. The product is filled into the chamber with the lower gate closed and thereafter the upper gate is also closed. A vacuum is then drawn in the degassing chamber through a vacuum tube located near the upper gate. When the pressure in the chamber ceases to drop, water is introduced into the chamber which displaces the rarified noncondensible gases in the entrapped voids causing the gases to be drawn out of the degassing chamber through the vacuum tube. When the water level in the chamber approaches the vacuum tube, the vacuum tube is closed allowing the water flowing into the chamber to continue until the vacuum has been eliminated in the chamber. As the vacuum drops the low pressure occluded voids draw in water to fill these voids at which time the lower gate is opened to discharge the dewatered product into the containers while the water flows through the perforated tube for recirculation as previously described. Water, or water vapor, enters the occluded voids after the degassing chamber and voids have been returned to approximately atmospheric pressure.

An article of manufacture results from the last described method is in the nature of a sealed container having a low free liquid porous food product therein with the noncondensible gas removed from its occluded voids and replaced by a liquid.

If the product to be filled into the pouch contains occluded voids only, such as a particulate product having occluded voids combined with a liquid medium or sauce, then the particulate product should be degassed alone as indicated above and the sauce should be added after the degassed product has been discharged into the container.

BRIEF DESCRIPTION OF THE DRAWINGS

FIG. 5 is a horizontal section taken along lines 5—5 of FIG. 1.

FIG. 6 is a diagrammatic horizontal section taken along lines 6—6 of FIG. 1.

FIG. 7 is a diagrammatic horizontal section taken along lines 7—7 of FIG. 1.

FIG. 8 is a diagrammatic horizontal section taken along lines 8—8 of FIG. 1.

FIG. 9 is a wiring diagram for controlling the water flow and, when used, the vacuum flow to one of the degassing chambers.

DESCRIPTION OF THE PREFERRED EMBODIMENT

Figure 1:
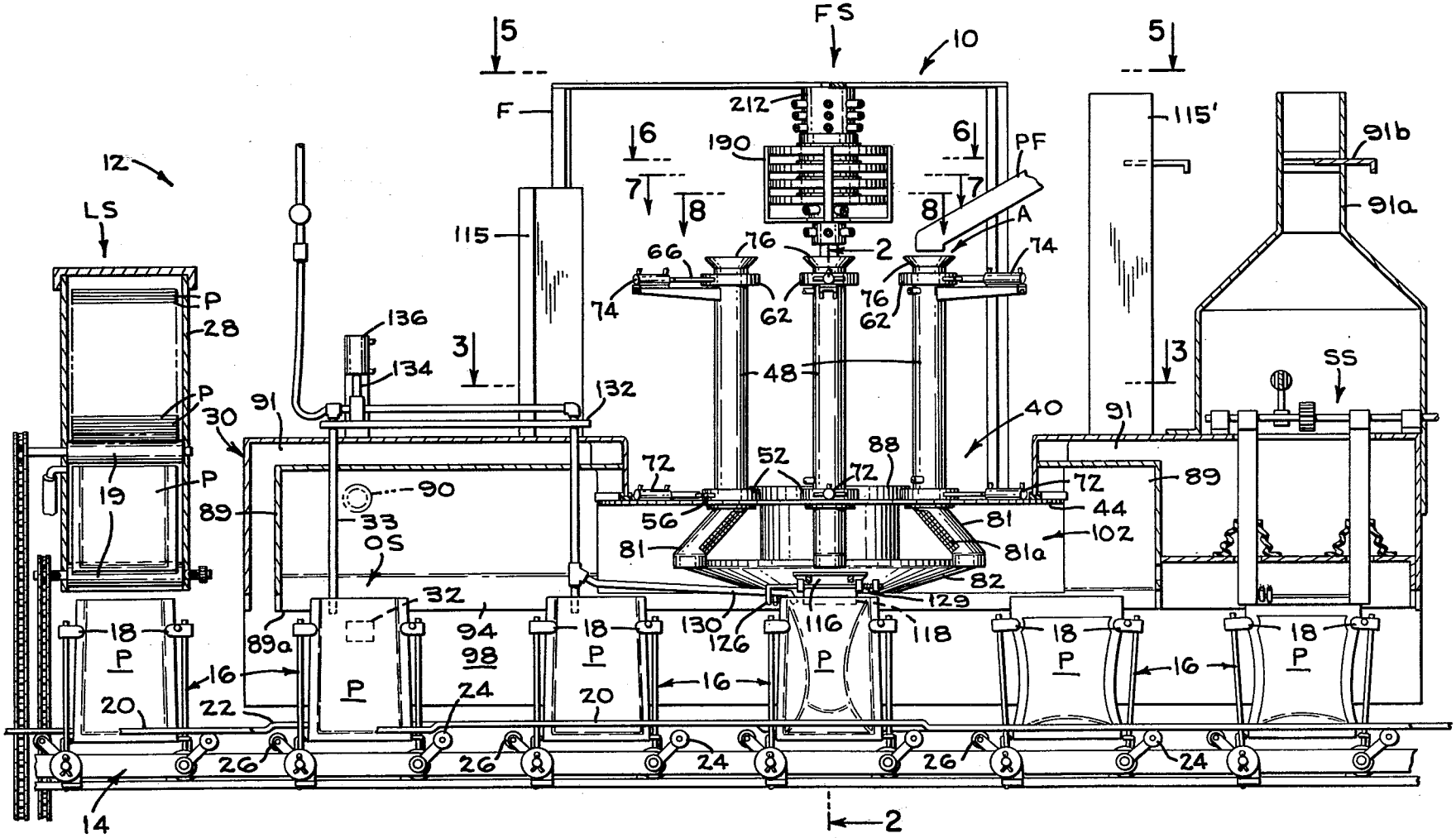
FIG. 1 is a diagrammatic longitudinal vertical section showing a portion of a pouch handling machine of which the fluid displacement particulate filler of the present invention is a part.

The fluid displacement particulate filler 10 (FIGS. 1–3) is illustrated as being a component of a machine 12 adapted to handle flexible containers or pouches P. The machine 12 is of the type disclosed in the above mentioned copending U.S. applications of Tony T. Chiu et al and Donald C. Wilson, the disclosures of which are incorporated by reference herein. It is to be understood, however, that other types of containers may be filled with particulate filler 10.

Briefly, the pouch handling machine 12 comprises an intermittently driven conveyor 14 (FIG. 1) having pouch carriers 16 thereon which include pouch clamps 18 that are actuated by cam tracks 20, 22 and associated cam followers 24, 26. The cam tracks are spaced from the followers when the pouch is open. When it is desired to feed a pouch into the clamp 18, the track portions of intermediate height engage the followers 24, 26 to hold the clamps 18 in position to receive the pouch. When it is desired to apply a resilient tensioning force across the mouth of the pouch to close the pouch, low portions of the cams engage the followers 24, 26. If a more detailed description of the pouch carriers 16 and cam tracks is desired, reference may be had to the aforementioned Chiu et al Application.

Each pouch P is loaded from a magazine 28 into the pouch clamps 18 of an associated carrier 16 at a pouch loading station LS by rollers 19 which also squeeze additional air from the flat pouch. The carrier 16 holds the mouth of the pouch closed until after the pouch has entered a steam tunnel 30 and has been indexed at an opening station OS where the pouch is opened with the aid of suction cups 32 and a jet of steam directed into the pouch from a nozzle 33 to further drive air therefrom. The pouch P is then indexed (in two steps) into the filling station FS at which time the fluid displacing particulate filler 10 of the present invention degasses and then fills the air-free (or de-gassed) particulate product into a substantially air-free pouch. The mouth of the filled pouch is then tensioned and closed by the clamps 18 of the carrier 16, and the pouch is advanced into a sealing staton SS at which time the mouth of the pouch is sealed. The filled and sealed pouch is then discharged from the conveyor 14 for cooling and storage or the like.

Since the several components and the drive mechanism and control circuits for rotating the filling turret and operating the other components of the machine 12 are fully disclosed in the aforementioned Chiu et al, and Wilson applications, reference may be had to these applications if a more detailed description of these features is desired.

Figure 2:
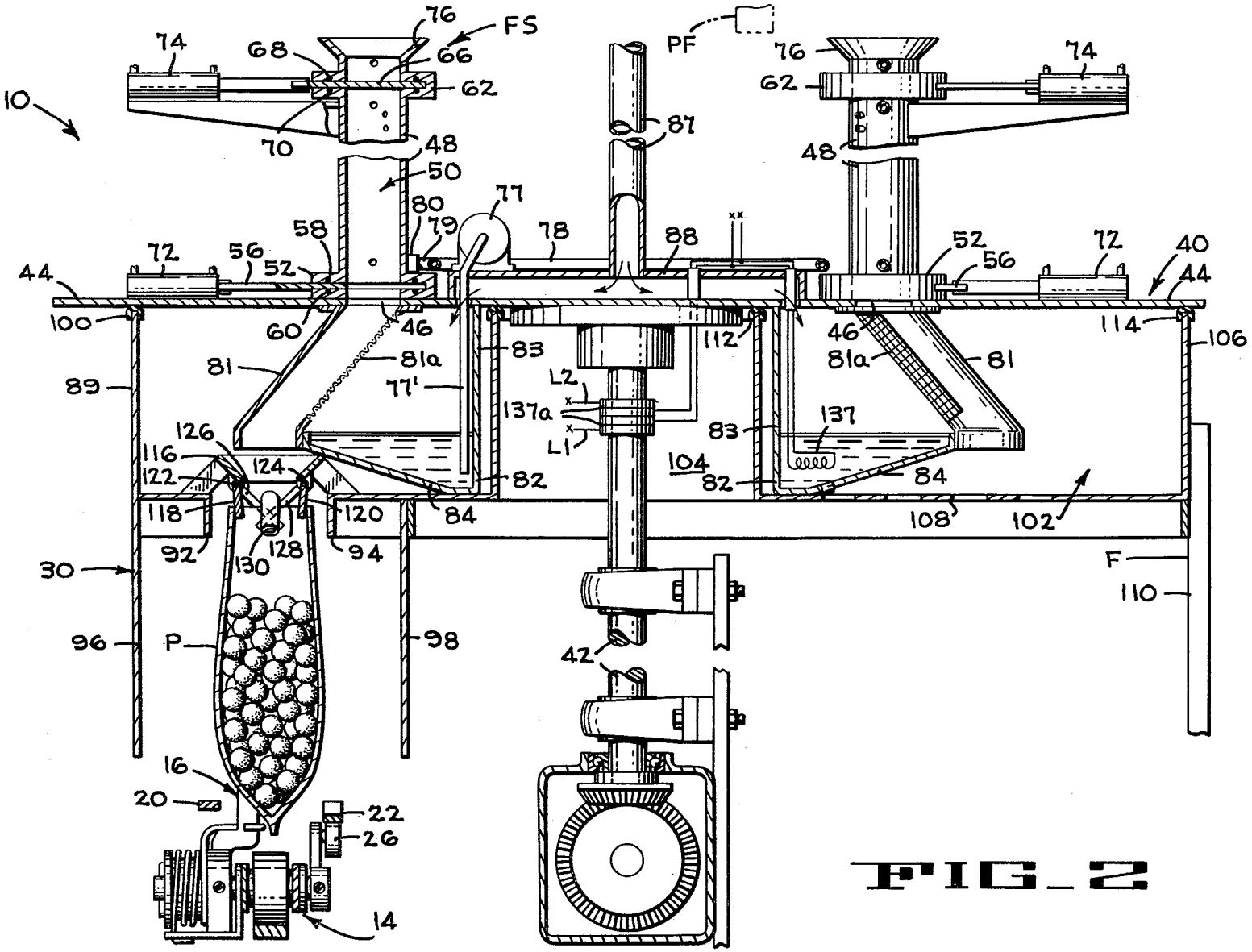
FIG. 2 is an enlarged vertical transverse section taken along lines 2—2 of FIG. 1 illustrating a degassing chamber shortly after it has discharged the product into a pouch, and illustrating a second chamber after it has been filled with the product.
Figure 3:
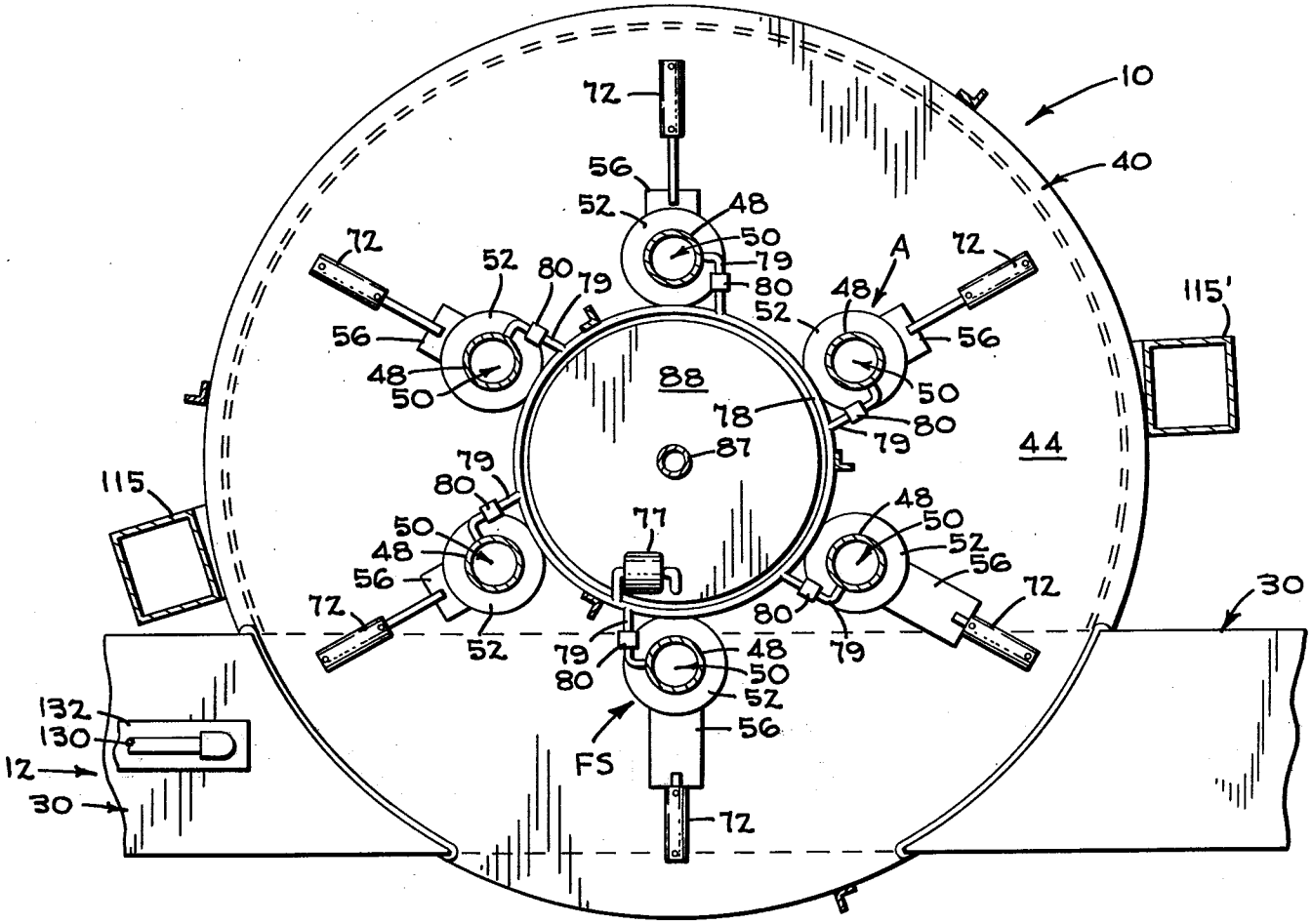
FIG. 3 is a horizontal section taken along lines 3—3 of FIG. 1 diagrammatically illustrating a pump and the recirculating water supply system.

Having reference to FIGS. 1–3, the fluid displacement particulate filler 10 of the present invention comprises a turret 40 that is supported by a vertical, intermittently driven shaft 42 (FIG. 2) that is journaled on the frame F of the machine. The turret 40 includes a horizontal plate 44 that has a plurality of product discharge openings 46 therein. A cylinder 48 defines a tubular particulate product degassing chamber 50 which is mounted over each discharge opening 46, and each cylinder includes a lower enlarged portion 52 that defines a lower gate seat having a lower gate 56 therein sealed by O-rings 58, 60. Similarly, each cylinder 48 includes an upper enlarged portion 62 that defines an upper gate seat having an upper gate valve 66 therein sealed by O-rings 68, 70.

Each lower gate 56 is opened or closed independently of the other gates by a pneumatic or air cylinder 72 supported on the turret plate 44, while each upper gate 66 is operated by a similar air cylinder 74 that is mounted on a bracket 75 secured to the associated cylinder 48.

A measured amount of particulate product (preferably a food product) is loaded into each degassing chamber 50, either manually or by a well known particulate filler PF (FIGS. 1 and 2), when the associated lower gate 56 is closed and the upper gate 66 is open. A funnel 76 on the upper end of each cylinder 48 aids in the chamber loading operation which occurs at chamber loading station A (FIG. 3) in the circular path of travel of the degassing chambers 50.

After each degassing chamber 50 (FIGS. 2, 3 and 4) is loaded with a particulate food product, a pump 77 supported on the turret 40 directs a gas displacing liquid (hereinafter referred to as water) into the associated degassing chamber 50 through an annular manifold 78, radial conduits 79, and solenoid operated valves 80. The water thereafter raises through the degassing chamber 50 and through the product therein to replace the gas in the voids with water.

An inclined liquid-product separation chute or tube 81 (FIG. 2) is associated with each chamber 50; and each inclined tube 81 has its upper end secured about one of the openings 46 to the lower surface of the turret plate 44 for rotation therewith. The lower discharge end of each tube 81 is aligned with an open pouch P when at the filling station FS for discharging the degassed particulate product into the pouch P therebelow. The lower half 81*a* of the inclined portion of the tube 81 is perforated for allowing the water to flow into and be collected in an annular sump 82. The sump 82 includes an annular inner wall 83 secured to the lower surface of the turret plate 44 and to an upwardly and outwardly inclined lower wall 84 that has its outer edge secured to the six water-product separation tubes 81. Makeup water is directed into the sump 82 as required through holes in the plate 44 from a source (not shown) through a conduit 85 (FIG. 4), a swivel joint 86, a rotatable tube 87, and an enlarged annular manifold 88 secured to the turret plate 44.

As described in the above mentioned Chiu et al and Wilson applications, the steam tunnel 30 (FIGS. 1 and 2) is open at the bottom and includes an inner portion 89 which receives atmospheric steam from an input port 90 at a sufficient rate to discharge some of the steam out the open bottom 89*a* and into the outer portion 91 thereof while additional steam flows through the tunnel for discharge through a stack 91*a* having a control valve 91*b* therein.

The mouth of the pouch P projects upwardly between walls 92, 94 into the steam in the inner portion 89 of the pouch steam tunnel 30 thus preventing air from entering the pouch. The steam that flows below the walls 92, 94 from the bottom of the inner portion of the tunnel raises between walls 96, 98 of the outer portion 91 of the tunnel thus minimizing cooling and condensation of the steam near the pouch mouth and also prevents air currents from entering the open mouth of the pouch.

As best indicated in FIGS. 1 and 2, the portion of the steam tunnel 30 at the filling staton FS is reduced in height with the rotating turret plate 44 defining the roof of the tunnel with outer wall 96 being sealed thereto by a U-shaped rubber strip 100. The inner wall 98 is sealed as by welding to stationary upright edges (not shown) of a generally annular steam chamber 102 to be described below. Thus, the discharge tube 81 of each degassing chamber 50 is disposed in a substantially pure steam atmosphere when passing through the steam tunnel 30 and steam chamber 102.

In order to prevent the discharge tubes 81 from filling with air when they move out of the steam tunnel 30, the stationary generally annular steam chamber or tunnel 102 (FIG. 2) is secured to the frame F and to the inner wall 98 of the tunnel 30. The annular tunnel 102 includes an inner cylindrical wall 104 and an outer wall 106 in the form of a cylindrical segment that is secured to the inner wall by a perforated floor 108. The free ends of the outer wall 106 and of the floor 108 are secured as by welding to the outer wall 98 and to a leg 110 of the frame F. The upper edges of the walls 104 and 106 are slidably sealed against the rotary turret plate 44 by U-shaped rubber seals 112 and 114. Thus, steam from the steam tunnel 30, and from an inlet conduit 115 (FIGS. 1 and 5), enters the annular tunnel 102 and flows out the lower end thereof and also out a vertical stack 115' thus preventing air from entering the tubes 81 and the portion of the sump not filled with water.

In order to assure proper entry of the dewatered product in to the pouch P, a somewhat oval chute 116 (FIG. 2) is rigidly secured to the inner tunnel walls 92, 94. Gates 118, 120 are pivotally mounted on the chute by shafts 122, 124 having gate opening fingers 126, 128 secured thereto, respectively. The gates 118, 120 are normally disposed above the path of movement of the pouch in generally horizontal, closed positions by torsion springs 129 (FIG. 1). After a pouch has been moved into the filling station FS, a high pressure steam tube 130 (FIGS. 1 and 2) directs steam into the pouch. The steam tube 130 is supported on a bar 132 connected to the piston rod 134 of a hydraulic or pneumatic power cylinder 136. Upon indexing of the pouch into the filling station FS, the open end of the tube 130 is moved downwardly to the position illustrated in FIG. 2. This movement causes the tube to engage the fingers 126, 128 which open the gates 118, 120 thereby engaging the side walls of the pouch P to positively open the mouth thereof. Thus, the gates 118, 120 prevent elongated particles of the product, such as shoe string potatoes or string beans, from draping over the upper edge of the pouch and thereby preventing a proper seal at the sealing station SS.

The preferred degassing liquid is hot water since hot water releases small gas bubbles on the surface of the particulate product. Accordingly, an electrical heater 137 (FIG. 2) is disposed in the sump 82 and is connected to the main lines L1 and L2 of an electrical power source through suitable slip rings 137a or the like.

The lower gate 56 of each degassing chamber 50 is closed at the chamber filling station A (FIGS. 3, 4 and 5), at which time a measured amount of particulate product is filled into the chamber 50, and remains closed until it reaches the pouch filling station FS at which time the lower gate is opened and remains open until it again returns to position A.

A pneumatic control system 138 is diagrammatically illustrated in FIGS. 4 and 5–8 for controlling the opening and closing of the lower gate 56 and upper gate 66 of the degassing chambers 50. Since the control system for each degassing chamber 50 is controlled by similar mechanism, only the air circuit for the degassing chamber 50 at the chamber filling station A will be described.

Figure 4:
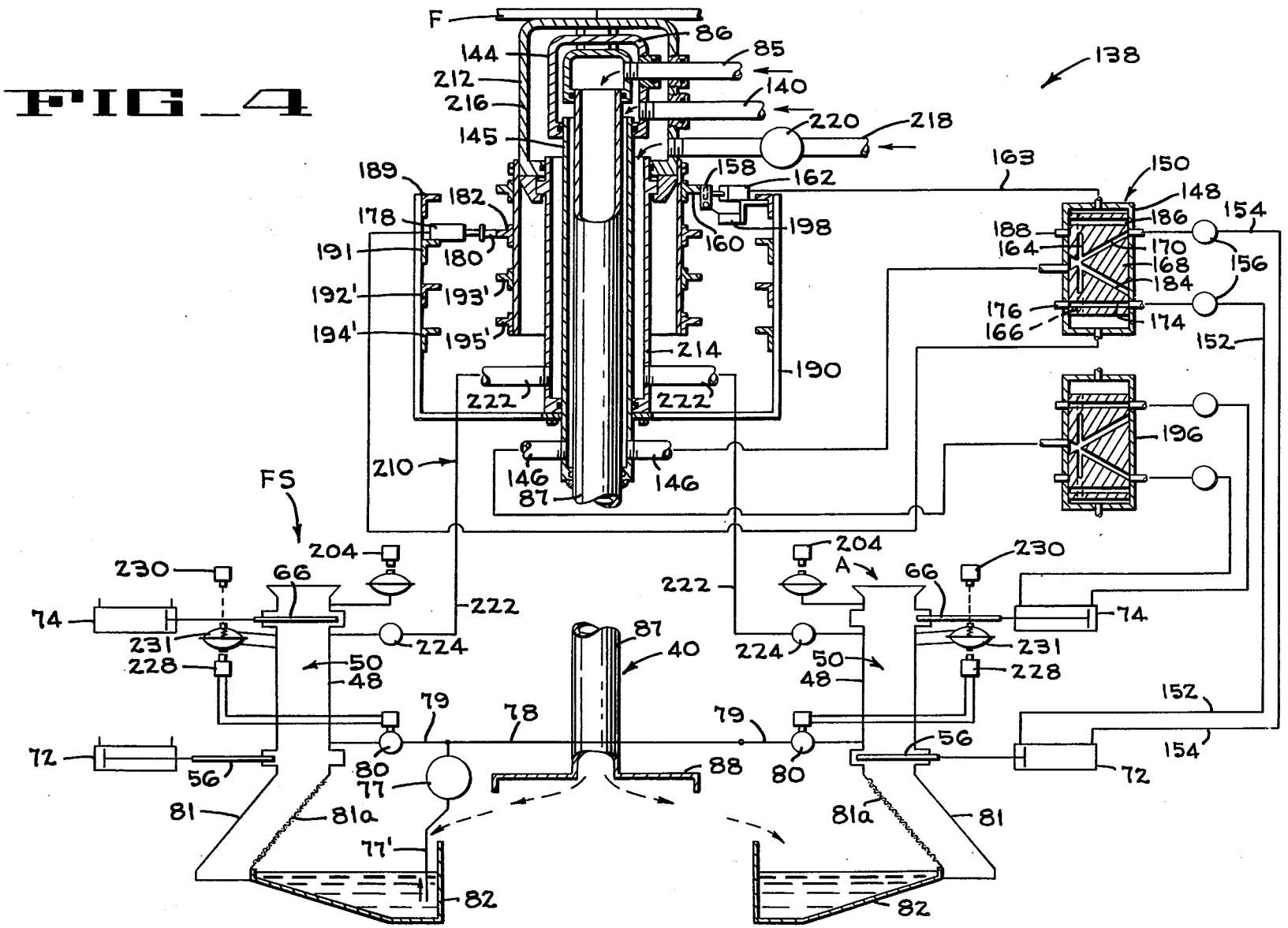
FIG. 4 is an enlarged diagrammatic section taken along lines 4—4 of FIG. 5 illustrating a multiple swivel joint, and certain pneumatic and vacuum circuit and the location of electrical switches for controlling the gates of one of the degassing chambers.

A stationary inlet conduit 140 receives high pressure air from a source (not shown) and directs the air into a swivel joint 144 having a rotatable cylindrical manifold 145 projecting downwardly therefrom. A conduit 146 connects the rotatable cylindrical portion 145 to the body 148 of a valve 150, which body is connected to opposite ends of the associated pneumatic cylinder 72 by conduits 152 and 154 having adjustable speed control valves 156 therein. Immediately before a degassing chamber is indexed into position A (FIGS. 4 and 5) the lobe 158 of a stationary cam 160 is engaged by and momentarily opens a bleed valve 162 that is connected to one end of the valve body 148 by conduit 163. As indicated in FIG. 4, high pressure air is directed into small bleed passages 164, 166 in the valve core 168 which directs high pressure air at equal pressure to opposite ends of the core 168. Thus, momentary opening of bleed valve 162 reduces the air pressure on that end of the core 168 causing the core to shift to the position illustrated in FIG. 4. High pressure air then flows from conduit 146 through valve core passage 170, conduit 154 and into the closed end of the cylinder 72 thereby closing the associated lower gate 56. Air is exhausted to the atmosphere from the other end of the cylinder 72 through conduit 152, a passage 174 in the core 168 and a vent opening 176 in the valve housing 148. The lower gate 56 remains closed until a gate opening bleed valve 178 contacts the cam lobe 180 (FIGS. 4 and 6) of a secondary stationary cam 182 immediately before the degassing chamber 50 enters the pouch filling station FS thus venting the other end of the valve 150 causing the core 168 to shift downwardly (FIG. 4) to said other end. High pressure air is then directed through a passage 184 in the core 168 and through conduit 152 and its speed control valve thereby opening the gate 56. Air is discharged from the other end of the cylinder 72 to the atmosphere through conduit 154, a passage 186 in the core 168, and a vent port 188 in the valve body.

It will be appreciated that the bleed passages 164, 166 in the core 168 do not communicate with the vent passages 174, 186. It will also be apparent that each lower gate 56 is operated by a pneumatic circuit which is identical to that described above, and that the speed control valves may be regulated to control the speed of opening and closing of the lower gates. As indicated in FIGS. 4 and 5, the lower gate closing bleed valve 162 is one of six identical bleed valves that are secured at equally spaced intervals to a ring 189 at an upper level for actuation by the lobe 158 of the cam 160. The ring 189 is bolted to a rotating spider 190 supported from the turret 40 by the water conduit 87. Likewise, the lower gate opening bleed valve 178 (FIGS. 4 and 6) is one of six valves in a lower level operated by the cam 182 and supported by a ring 191 on the spider 190.

The upper gates 66 are each closed by one of six upper gate closing bleed valves 192 (only one being shown in FIG. 7) secured to rotating ring 192′ and actuated by a stationary cam lobe 193, which lobe 193 is secured as by bolting to the cam 193′ near the station FS if vacuum is not to be used; and is secured to the cam 193′ near the station A if vacuum is to be used as indicated in dotted lines in FIG. 7. The upper gate 66 is opened by one of six upper gate opening bleed valves 194 (only one being shown in FIG. 8) secured to rotating ring 194′ and actuated by another stationary cam lobe 195 of a stationary cam 195′. The pneumatic circuits for controlling the upper gates includes a pneumatic valve 196 (FIG. 4), and are the same as described above except for the point at which the upper gates are opened and closed as indicated above and as will be made more apparent hereinafter.

If the product being degassed has noncondensible gases only in its entrapped voids; i.e., in the voids between particles, then the cam lobe 193 (FIG. 7) is positioned to close the upper gate only after sufficient water has entered the associated degassing chamber to raise to a level above the upper gate. If vacuum is to be applied to displace noncondensible gases from occluded voids in the product itself, then the lobe 193 is positioned to close the upper gate 66 immediately after the product is filled into the associated degassing chamber at position A as the chamber begins to move away from that position.

The upper gate is opened, when handling either of the above products, by engagement of the associated upper gate opening bleed valve 194 with the lobe 195 on the cam 195′ shortly before the degassing cylinder enters the chamber loading station at position A.

The degassing water flow is controlled as indicated below having reference to FIGS. 2 and 4–9. As indicated in FIG. 2, the pump 77 draws gas displacing water from the sump 82 through suction pipe 77′ and directs it through the annular water manifold 78 and into the degassing chamber 50 through radial conduits 79 and solenoid operated water valves 80.

When the product being processed includes noncondensible gas only in the entrapped voids between articles, a switch 198 (FIG. 9) which energizes the solenoid SOL-1 of the associated valve 80 to direct water into the associated degassing chamber 50 is mounted (along with five other switches for the other degassing chambers 50) on the switch ring 189 (FIG. 4). The switch 198 is positioned to be engaged by the cam lobe 158 shortly after the associated lower gate has been closed and the filled chamber moves out of the chamber filling position A (FIG. 5).

The switch 198 (FIG. 8) is connected in series with the solenoid SOL-1 of the associated water valve 80, a relay R, and a manual selector switch 200 between main lines L1 and L2. When the switch 198 is closed by cam lobe 158 the relay R is energized closing relay contact R-1, and solenoid SOL-1 is energized thus opening the valve 80 allowing water to raise through the gas filled voids between the independent particles of the product in the associated degassing chamber 50. Since the product does not include occluded voids, a manual switch 200 is positioned as indicated in FIG. 9 to close a first holding circuit having relay contact R-1 and a normally closed upper water level or diaphragm switch 204 (FIG. 4) therein. The holding circuit thus maintains the solenoid SOL-1 energized and causes water to rise in the associated degassing chamber 50 until the water level moves above the upper gate and opens normally closed diaphragm switch 204 thus de-energizing relay B thereby opening relay contacts R-1 and also de-energizing solenoid SOL-1 which closes associated water valve 80. The upper gate 66 is closed shortly thereafter as previously described and remains closed until after the product has been discharged into the pouch at the filling station FS.

If the product includes both entrapped voids and occluded voids, both the lower gate 56 and the upper gate 66 of an associated product filled degassing chamber 50 must be closed and the space within the chamber must be evacuated prior to introducing water into the chamber. In this regard, a vacuum system 210 (FIG. 4) is provided which includes a swivel joint 212 having a rotatable portion 214 secured to the water makeup tube 87 and a stationary portion 216 which is connected by conduit 218 having a valve 220 therein to a vacuum source (not shown). A plurality of radially extending tubes 222 having normally closed solenoid operated vacuum valves 224 therein are connected between the rotatable portion 214 of the swivel jont 212 and the degassing chambers 50.

When handling the type of product that includes the occluded void gases, the manual selector switch 200 (FIG. 9) is first engaged with an alternate circuit as indicated in dotted lines in FIG. 9. The upper gate closing cam lobe 193 is positioned as indicated in dotted lines in FIG. 7 to engage bleed valve 192 and close the associated upper gate 66 immediately after the degassing chamber 50 moves out of the chamber filling station A. After the upper gate 66 is closed, a vacuum switch 226 contacts the lobe 193 thus closing a circuit (FIG. 9) which energizes solenoid SOL-2 of the associated vacuum valve 224 (FIG. 4) of the vacuum system 210. Solenoid SOL-2 is in series between main lines L1 and L2; which series circuit also includes selector switch 200, cam switch 226, a normally closed water level switch 228 positioned immediately below the upper gate 66, and relay coil R2. Energization of relay R2 closes relay contact R2-1 which establishes a holding circuit across cam switch 226. Vacuum is then drawn in the associated degassing chamber 50 until a predetermined negative pressure is reached at which time a normally open vacuum switch 230 controlled by a spring assisted water-vacuum diaphragm 231 closes thereby energizing relay R and solenoid SOL-1 to open the water valve 80 and directs water into the degassing chamber 50. As the water rises in the chamber 50, vacuum continues to be drawn to retain the predetermined negative pressure until the water level reaches and opens the water level switch 228 thus breaking the circuit to the vacuum valve solenoid SOL-2 and relay R2 closing vacuum valve 224. The water level in the degassing chamber continues to rise until the pressure therein returns to about atmospheric pressure thereby actuating diaphragm 231 opening vacuum valve 230 de-energizing solenoid SOL-1 and closing water valve 80. As the pressure within the degassing chamber 50 returns to atmospheric pressure, water or water vapor enters the occluded voids in the particles themselves thereby replacing the noncondensible gas that has previously filled the occluded voids.

Although the wiring diagram of FIG. 9 illustrates circuitry for only one of the degassing chambers 50, it will be understood that five identical circuits are provided for the other five degassing chambers 50 of the preferred embodiment of the invention.

Since the operation of the fluid displacement particulate filler 10 (FIGS. 1 and 2) has already been described in conjunction with the description of the components of the machine 12, only a brief summary of the operation will now be given.

Each container or pouch P is intermittently advanced by the conveyor 14 through the steam tunnel 30, is opened, and its headspace is substantially air-free when it is indexed into the container filling station FS. The filling turret 40 is intermittently driven in timed relation with the conveyor 14, and each degassing chamber 50 receives a measured quantity of a particulate product at the chamber filling station A (FIG. 3), either manually or by suitable mechanism PF, after the lower gate 56 has first been closed.

If the product includes noncondensible gases only in its entrapped voids (the voids that exist between the separate pieces of product) then the selector switch 200 of the electrical control circuit (FIG. 9) is selectively positioned to immediately cause a liquid (preferably heated water) to begin flowing upwardly in the degassing chamber 50 (FIG. 4) through the voids thereby displacing the gases therefrom. When the water reaches a level slightly above the upper gate 66 and activates a pressure or water level switch 204, the water supplied to the degassing chamber 50 is stopped and the upper gate 66 is closed. The degassing chamber 50 is thereafter indexed above a pouch P to be filled at which time the lower gate 56 is opened. The water and product then gravitates from the degassing chamber 50 with the product entering the pouch P and the water flowing through the perforations 81a in the inclined tube 81 for collection in the sump 82 and subsequent recirculation. The measuring chamber 50 then returns to the chamber filled station A during which time the lower gate 56 is closed and the upper gate 66 is opened to repeat the cycle of operation.

If the product contains noncondensible gases in both entrapped voids and in occluded voids (voids within the product itself), then the product is vacuumized prior to the water displacement operation. The selector switch 200 of the electrical control circuit of FIG. 9 is moved to its dotted line position to permit activation of the vacuum system. The particulate product is then filled into the degassing chamber 50 with the lower gate 56 being closed. The upper gate 66 is then closed and vacuum is drawn in the degassing chamber 50. When the pressure in the chamber 50 stops dropping, the normally open vacuum switch 230 (FIG. 9) closes thus directing water into the chamber 50. When the water level reaches switch 228, the vacuum line is closed but water continues to raise until the pressure within the chamber 50 returns to about atmospheric pressure at which time vacuum switch 230 opens thus terminating the supply of water to the associated measuring chamber 50. With the pressure within the chamber 50 again at atmospheric, water or water vapor enters and fills the occluded voids. The product and water are then separated at the filling station FS as previously described.

From the foregoing description it is apparent that the fluid displacement particulate filler of the present invention utilizes a liquid which raises through and displaces noncondensible gases from the entrapped voids between the separate particles, and then separates the liquid from the product causing the liquid to enter a sump for reuse and the product to enter a pouch. If occluded voids are present in the product itself, then a vacuumizing step precedes the water displacement step.

Although the best mode contemplated for carrying out the present invention has been herein shown and described, it will be apparent that modification and variation may be made without departing from what is regarded to be the subject matter of the invention.

I claim:

1. An apparatus for displacing a noncondensible gas from a particulate product in a degassing chamber and thereafter packaging the product comprising, means for moving a liquid through the product and through at least a portion of the degassing chamber to displace a non-condensible gas from the voids between particles of the product, means for precluding the reentry of noncondensible gases into said voids, means for draining the liquid from the product, and means for loading the product into a substantially air-free container.

2. An apparatus according to claim 1 wherein the liquid moves upwardly through the voids in the product.

3. An apparatus according to claim 1 and additionally including means for heating the liquid to approximately its boiling point.

4. An apparatus according to claim 1 wherein the liquid is water.

5. An apparatus according to claim 2 wherein said means for precluding reentry of the noncondensible gas includes means for closing the upper end of the degassing chamber after the liquid has raised to a level thereabove.

6. An apparatus according to claim 1 and additionally comprising means for drawing a vacuum in the chamber prior to introducing the liquid into the chamber for evacuating noncondensible gases from occluded voids in the product, and means for returning the pressure within the chamber to about atmospheric pressure prior to draining the liquid from the product.

7. An apparatus for displacing a noncondensible gas from a particulate product and thereafter loading the degassed product into a substantially air-free container comprising: means defining a degassing chamber having a particulate product therein; said chamber including a lower gate and an upper gate; means for closing said lower gate; means for directing a liquid into said degassing chamber and through the particulate product to displace substantially all of the noncondensible gas entrapped in voids between pieces of the product with the liquid and for additionally displacing substantially all of the non-condensible gas from said chamber; means for closing the upper gate; means for thereafter opening said lower gate; and liquid-product separating means communicating with said chamber through the open lower gate, communicating with a substantially air-free container which collects the degassed product therein; and also communicates a liquid collecting means which collects the liquid therein.

8. An apparatus according to claim 7 wherein the liquid is water.

9. An apparatus according to claim 7 wherein the liquid is hot water.

10. An apparatus according to claim 7 wherein said upper gate is closed after the liquid level has raised to a level above said upper gate.

11. An apparatus according to claim 7 wherein said upper gate is closed prior to the introduction of liquid into said degassing chamber, and additionally comprising means for drawing a vacuum in said degassing chamber through a vacuum conduit near the upper end of said chamber for withdrawing noncondensible gases therefrom and from occluded voids in the product, and control means for directing the liquid into said chamber after a substantial vacuum has been created therein and for continuing to draw a vacuum until the water level raises to approximately the level of said vacuum conduit, said control means thereafter closing said vacuum line and allowing the chamber pressure to reach approximately atmospheric pressure prior to terminating flow of liquid into said chamber thereby allowing liquid to enter the occluded voids.

12. An apparatus according to claim 7 wherein said liquid-product separating means is an inclined tube having perforations in its lower portion through which water flow into said liquid collecting means, the dewatered product flowing out of the tube into the container.

13. An apparatus according to claim 6 wherein said inclined tube and the open end of the container are maintained in a steam atmosphere.

14. An apparatus according to claim 12 and additionally comprising pump means for drawing the liquid from said liquid collecting means and making it available for recirculation through said degassing chamber.

15. An apparatus according to claim 7 wherein said degassing chamber is one of a plurality of chambers and said container is one of a plurality of containers, and additionally comprising a turret for supporting said degassing chambers at equally spaced intervals, a conveyor for supporting the containers at equally spaced intervals, and means for driving said conveyor and turret in timed relation for filling each substantially air-free container with a particulate product devoid of noncondensible gases.

16. An apparatus according to claim 15 wherein said driving means intermittently drives said conveyor and said turret.

17. A method of displacing a noncondensible gas from a particulate product in a degassing chamber and thereafter packaging the product comprising the steps of: moving a liquid through the product and through at least a portion of the degassing chamber to displace a noncondensible gas from the voids between particles of the product, precluding the reentry of noncondensible gases into said voids, draining the liquid from the product, and loading the product into a substantially air-free container.

18. A method according to claim 17 wherein the liquid moves upwardly through the voids in the product.

19. A method according to claim 17 and additionally including the step of heating the liquid to approximately its boiling point.

20. A method according to claim 18 wherein the liquid is water.

21. A method according to claim 19 wherein the liquid is hot water.

22. A method according to claim 18 wherein said noncondensible gas reentry is precluded by closing the upper end of the degassing chamber after the liquid has raised to a level thereabove.

23. A method according to claim 17 and additionally including the step of drawing a vacuum in the chamber prior to introducing the liquid into the chamber for evacuating noncondensible gases from occluded voids in the product, and returning the pressure within the chamber to about atmospheric pressure prior to draining the liquid from the product.

24. A method of displacing a noncondensible gas from a particulate product in a degassing chamber having an upper gate and a lower gate and thereafter packaging the product comprising the steps of: closing the lower gate, loading the particulate product into the chamber, moving water upwardly in the degassing chamber and through the product to displace a noncondensible gas from the entrapped voids between particles of the product, closing the upper gate, opening the lower gate, and separately discharging and collecting the liquid and product within an air-free atmosphere.

25. A method according to claim 24 wherein the product is collected in a container, and thereafter sealing the container.

26. A method according to claim 25 wherein the upper gate is closed after the water has moved to a level above that of the upper gate.

27. A method according to claim 25 wherein the upper gate is closed prior to the introduction of water into the chamber, and additionally including the step of drawing a vacuum in the chamber for evacuating noncondensible gases from occluded voids in the product, and returning the pressure within the chamber to about atmospheric pressure prior to opening the lower gate to fill the occluded voids with water, and thereafter opening the lower gate.

28. A method according to claim 24 and additionally including the step of heating the water.

* * * * *